United States Patent [19]

Ong

[11] 4,307,697

[45] Dec. 29, 1981

[54] COMPLEX SWIRL STATIC MIXER FOR ENGINES

[76] Inventor: Siak-Hoo Ong, 3-17-21, Koishikawa, Bunkyo, Tokyo, Japan

[21] Appl. No.: 172,693

[22] Filed: Jul. 28, 1980

Related U.S. Application Data

[63] Continuation of Ser. No. 727,997, Sep. 30, 1976, abandoned.

[30] Foreign Application Priority Data

Oct. 2, 1975 [JP] Japan ..... 50-119579

[51] Int. Cl.[3] ..... F02M 29/00

[52] U.S. Cl. ..... 123/590; 123/593; 261/79 R; 48/180 R

[58] Field of Search ..... 123/590, 592; 48/180 R, 48/180 B, 180 M; 261/79 R

[56] References Cited

U.S. PATENT DOCUMENTS

| | | | |
|---|---|---|---|
| 1,300,015 | 4/1919 | Reed | 123/590 |
| 1,969,202 | 8/1934 | Bugaud | 123/590 |
| 2,017,043 | 10/1935 | Galliot | 123/590 |
| 2,152,206 | 3/1939 | Neal | 123/590 |
| 2,384,681 | 9/1945 | Janes | 123/590 |
| 3,395,899 | 8/1968 | Kopa | 123/590 |
| 3,437,467 | 4/1969 | Jacobus | 120/590 |
| 3,544,290 | 12/1970 | Larson | 123/590 |
| 3,861,376 | 1/1975 | Ashley | 123/590 |
| 3,930,485 | 1/1976 | Konomi | 123/590 |
| 3,938,967 | 2/1976 | Reissmuller | 123/590 |

FOREIGN PATENT DOCUMENTS

| | | | |
|---|---|---|---|
| 494738 | 8/1928 | Fed. Rep. of Germany | 123/590 |
| 1213642 | 11/1958 | France | 123/590 |
| 176437 | 6/1935 | Switzerland | 123/590 |

*Primary Examiner*—Ira S. Lazarus
*Attorney, Agent, or Firm*—Holman & Stern

[57] ABSTRACT

The present invention relates to a new method which improves the combustion efficiency of engines by whirling the air-fuel mixture partitively in different directions forming complex swirls. The present device is fixed in the inlet manifold of an engine and generates complex swirls. Several embodiments of the invention have complex-swirl-generating devices fixed at the manifolds of combustion engines as a position near the inlet valves thereof.

14 Claims, 18 Drawing Figures

COMPLEX SWIRL STATIC MIXER FOR ENGINES

This is a continuation of application Ser. No. 727,997, filed Sept. 30, 1976 now abandoned.

BACKGROUND OF THE INVENTION

The air/fuel mixture of an internal combustion engine may be formed by a carburator or by a fuel injection device. Particles of fuel when entering the combustion chamber of an engine are not small enough to insure complete combustion. There are many devices and methods which cause better mixing of the mixture before combustion. One group of these devices involves the use of a static mixer for scattering the particles of fuel. However, these devices of static mixing type are not good enough to give good performance at all running conditions. Some give bad acceleration but good reduction in CO exhaust at idle rotation like the known one-direction-swirl generating mixer when fixed under the carburator. Others give low power output like the using of a metallic net fixed at the passage of the inlet manifold.

The present invention relates to a new method which improves the vaporization of an air-fuel mixture by generating the mixture partitively in different directions forming complex swirls. The formation of complex swirls does not give a big centrifugal force to the fuel particles like the single-direction-swirl mixer does. It rotates the mixture partitively in different directions so that the mixture is being whirled towards the center of an inlet manifold thereby giving good mixing of fuel with air.

It is the present object of the invention to improve the combustion efficiency of engines by rotating the mixture in different directions to form complex swirls through the use of a multi-swirl-generating device.

It is another object of the present invention to reduce the polluted exhausts of engines by the use of complex swirl-producing devices mounted in the inlet manifold of a combustion engine.

It is also another object of the present invention to develop several clean internal combustion engines with high power output by using the present method of fuel and air and through the use of devices based on the present method.

It is also another object of the present invention to provide high power and smooth driving conditions for modern lean burning internal combustion engines.

DESCRIPTION OF THE PREFERRED EMBODIMENTS

Figure 1:
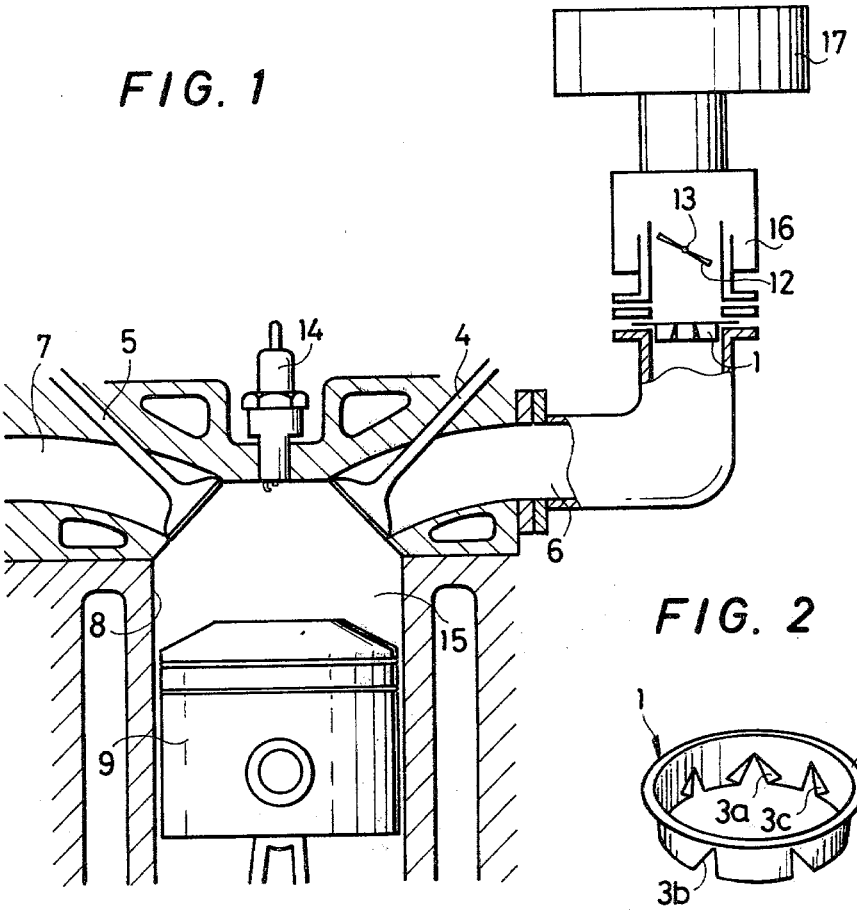
FIG. 1 is an elevational view in partial section illustrating a first embodiment of the present invention.

The present method of improving the combustion efficiency of internal combustion engines is by generating complex swirls using a static mixer which can be a circular ring usually being cut and bent inwardly about portions of the circumference of the ring to form wings. Sometimes, the mixer is formed by attaching wings on the inner circumference of a part of a manifold or the spacer under a carburator. These wings usually are arranged into several sets. In order to rotate the mixture, wings of the same set are arranged facing the same circular direction of the circumference, while wings of neighbouring sets are faced in the opposite circular direction of the circumference. A pair of neighbouring wings of different sets facing each other are called a pair of concentrating wings, while a pair of wings facing against each other are called a pair of separating wings. A wing which changes the direction of flow is called a directing wing while a centering wing directs the flow towards the center of the mixer.

Many types of complex swirls can be generated by suitable designs by using several combinations of the four types of wings. When the mixture passes through such a mixer fixed in the manifold, the wings of the mixer change the direction of flow so that the flow is caused to be rotated partitively in different directions towards the center of the manifold, thereby forming complex swirls.

In order to create a good result of mixing, it is found that the number of sets should not be more than six and is usually partitively arranged in even symmetric sets, since this is the best arrangement for these symmetric complex swirls to be rotated effectively towards the center.

When the mixer is being fixed under the carburator, in order to get a good performance at all slotter opennings, a pair of separating wings of neighbouring sets or a concentrating wing should be arranged at a position which is located on the line perpendicular to the slotter valve of the carburator. This setting ensures good vaporization of gas even at small slotter openings, since the flow of gas after passing the slotter valve is being changed effectively by the pair of separating wings or a centering wing to insure better vaporization.

For an internal combustion engine having a multi-swirl mixer, the best percentage of the total projecting area of wings on the crossection of the manifold depends on the structure, length, angle and number of the wings. However, it is found that this percentage should be between 5 to 50% of the total area of crossection.

When the mixer is fixed in the manifold at a position near the inlet valve, complex turbulences are being formed also inside the combustion chamber. The flow could be used to clean the poles of the plugs while inleting the mixture, and gives a fast transfer of flame after ignition; consequently giving better fuel consumption, high power and low polluted exhausts.

A preferred embodiment of the mixer has two sets of wings fixed near the inlet valve of a manifold in an internal combustion engine. The angle of the center line of the two sets of wings can be designed such that the combination flow of the two seperate swirls at the center of the mixer is facing towards the plug.

Another embodiment of the present invention is the formation of double swirls inside the combustion chamber by two swirl-generating devices fixed at two separate inlet valves of the engine. Each device has wings rotating the mixture in one direction. Swirls generated by the two devices are rotating in opposite directions towards the center of the combustion chamber. If the wings of the devices are designed in a manner such that the flow of gas from the junction of inlet valves is towards the plug, it cleans the plug and creates smooth transfer of flame. In the case of using two ignition plugs, the arrangement of flow could be also directed from each side of the inlet valves towards the plugs respectively.

Another embodiment of the present invention is the design of an engine with two inlet valves fixed with two double-swirl mixers near the inlet valves, each of the mixers composed of two sets of wings which direct the flow of gas from the center of each valve towards the plug or plugs, respectively.

Many applications of the present invention of generating complex swirls and the devices of the invention could be arranged in several other forms of internal combustion engines, including Wankel's rotary engine and two-stroke reciprocating engines. It is expecially important to mention that the present invention could be used for all the modern lean burning internal combustion engines which operate on a lean air-fuel mixture like the sub-chamber stratified charge system, the turbulence generating pot system and some others. The present invention gives a better mixing of air and fuel of any lean burning engine, thereby improving the performance, power output, fuel consumption and polluted exhausts of the engine, by fixing a complex swirl mixer in the passage of the inlet manifold which inlets the lean mixture.

FIG. 1 shows an embodiment of the present invention, wherein a complex swirl mixer 1 is fixed at the entrance of a manifold 6 under a carburator 16. The air-fuel mixture formed by the carburator will be rotated partitively in different directions towards the center of the manifold when passing through it. Other parts are the usual portions of a reciprocating combustion engine, where 4 is the inlet valve; 5, the exhaust valve; 7, the exhaust; 8, the cylinder; 9, the piston; 12, the slotter valve; 13, the axis of the slotter valve; 14, the plug; 15, the combustion chamber; 17, the air-cleaner.

Figure 2:
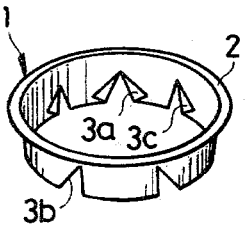
FIG. 2 is a perspective of one embodiment of the present complex swirl mixer.
Figure 3:
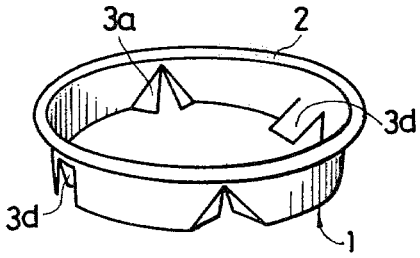
FIG. 3 is a perspective view of a second embodiment of the present complex swirl mixer.
Figure 4A:
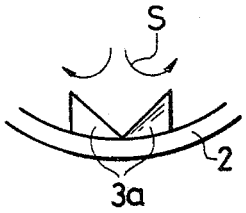
FIGS. 4*a*, 4*b*, 4*c* and 4*d* are detailed schematic views of the several types of wings used to form a complex swirl mixer according to the invention.
Figure 4B:
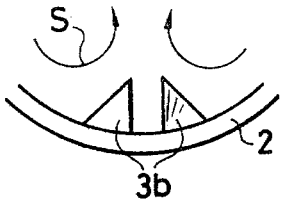
Figure 4C:
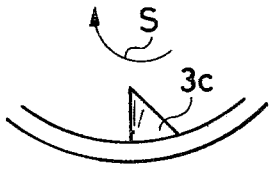
Figure 4D:
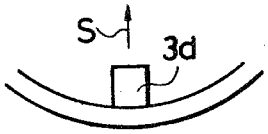

As shown in FIG. 2, a complex swirl mixer 1 is formed by a press process of a metalic sheet such that it has a flange 2 attached to the main body of the mixer and has several types of wings 3*a*, 3*b*, 3*c* cut and bent inwardly at spaced loci of the circumference of the mixer. FIG. 3 is another embodiment of the complex swirl mixer 1.

There are four types of wings according to their functions, namely, separating wings 3*a*, which separate the flow into two different directions; concentrating wings 3*b*, which concentrate the flow to a point at the circumference; guiding wing 3*c*, which guides the flow to a desired direction, and centering wing 3*d*, which guides the flow to the center of the device. The relations of the flows of gas with these four types of wings are shown in FIGS. 4A, 4B, 4C and 4D, respectively.

Figure 5:
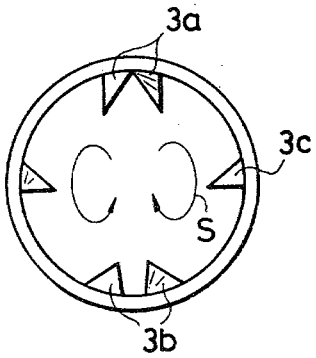
FIG. 5 is a detailed plan view in partially schematic form illustrating a further embodiment of the invention.
Figure 6:
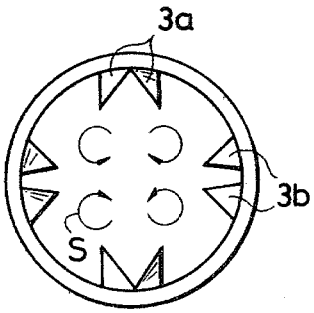
FIG. 6 is a detailed plan view in partially schematic form illustrating yet another embodiment of the present swirl mixer.
Figure 7:
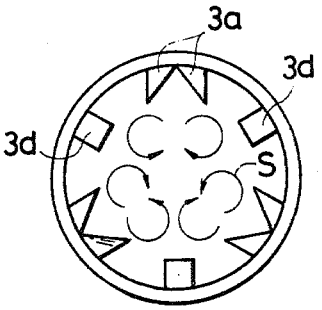
FIG. 7 is a detailed plan view in partially schematic form illustrating another embodiment of the present complex swirl mixer.

Using the combination of above mentioned types of wings, we can have many types of swirl-generating devices. FIG. 5 shows a mixer which is formed by a pair of seperating wings 3*a*, two guiding wings 3*c* and a pair of concentrating wings 3*b*. When a flow passes through the mixer, it generates two independent symmetric swirls which rotate towards the center, one of which is on the right hand side of the device, another on the left hand side of the device. Wings which are on each side can be considered as a set of swirl-generating wings. FIG. 5 is a mixer with two sets of swirl-generating wings. FIG. 6 shows a four-swirl-generating mixer composed of four sets of wings. FIG. 7 shows a six-swirl-generating mixer formed by three pairs of separating wings 3*a* and three centering wings 3*d*. It is clear from FIG. 7 that the function of a centering wing is equilvalent to a pair of concentrating wings.

Figure 8:
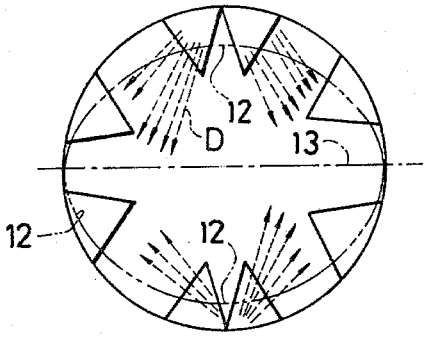
FIG. 8 is a detailed schematic view illustrating a mode of operation of the present invention.

FIG. 8 shows one way of fixing the device under the carburator. A pair of separating wings are located on the line which is perpendicular to the axis 13 of the slotter valve 12. At small slotter valve openings the flow of gas after passing the slotter valve is efficiently changed by the seperating wings to assure good vaporization as shown by D of FIG. 8.

Figure 9:
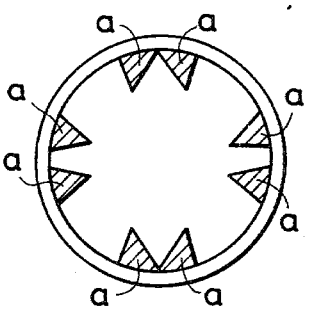
FIG. 9 is a detailed schematic view illustrating the projected area of the wings of an embodiment of the present swirl mixer on the cross-sectional plane of a manifold of an internal combustion engine.

The projection of the wings on the crossection plane of the manifold is shown by the dark portions a of FIG. 9. The sum of the total area of the dark portions a should be between 5 to 50% of the crossection of manifold.

Figure 10:
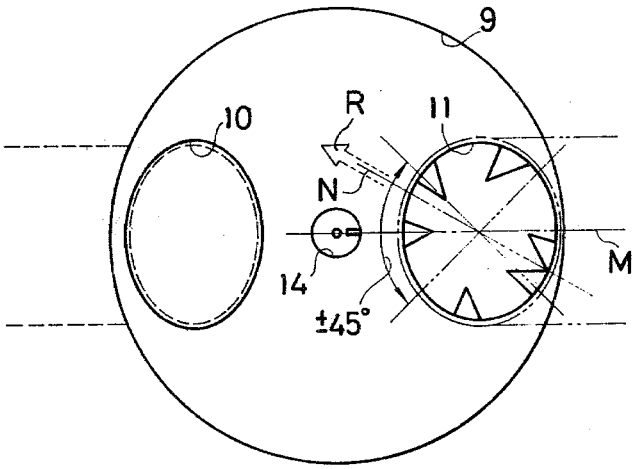
FIG. 10 is a detailed schematic view of a cylinder head of an engine fitted with a complex swirl generating mixer of the invention.

FIG. 10 shows the cylinder head of an embodiment of the present invention, where a two-swirl-generating device is fixed at a position near the inlet valve 11 so that a strong turbulence is being generated inside the combustion chamber to improve the speed of the transfer of flame. R is a turbulence inside the chamber. N is the center line of the two sets of swirls-generating wings and M is the line connecting the center of the ring with the plug 14. The range of angle between 0° and line N and M is between 45°. However, it is better to design them to be 0°, in order to get a good cleaning effect of the poles of plug while inleting the mixture.

Figure 11:
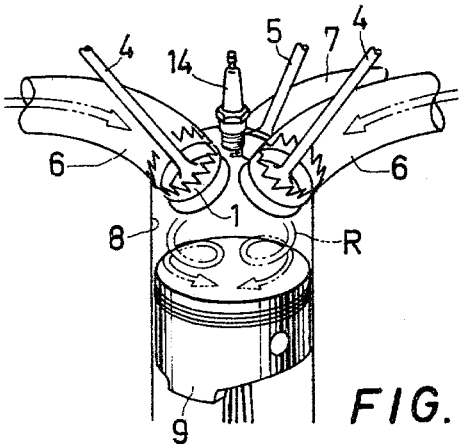
FIG. 11 is an idealized perspective view illustrating the disposition of two swirl generating devices in the cylinder head of an engine.

FIG. 11 is another embodiment of the present invention, where two swirl-generating devices 1 are located respectively near the two inlet valves 4 of an engine.

Figure 12:
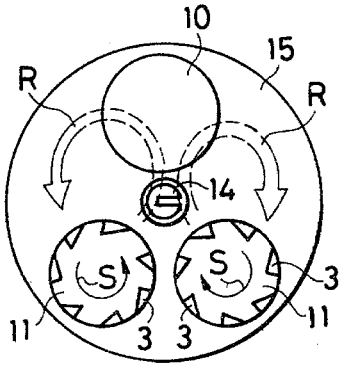
FIG. 12 is a schematic view illustrating the flow of gas in a cylinder head fitted with two of the present devices.
Figure 13:
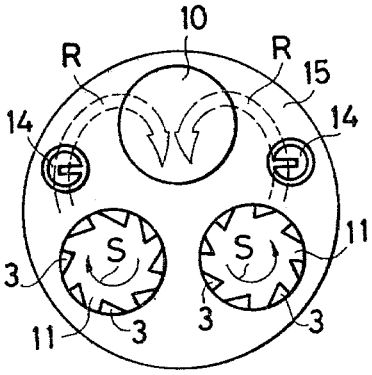
FIG. 13 is a schematic view of the flow of gas caused by a further arrangement of two of the present swirl generating devices in a cylinder head.

FIGS. 12 and 13 show the cylinder heads of two embodiments of the present inventions, in which the flow of gas is being directed from the valves 4 towards the plug or plugs 14 by two single-direction-swirl-generating devices. These embodiments give very strong turbulence of two independent swirls so that very low fuel consumption of the engines can be attained at any operation condition.

Figure 14:
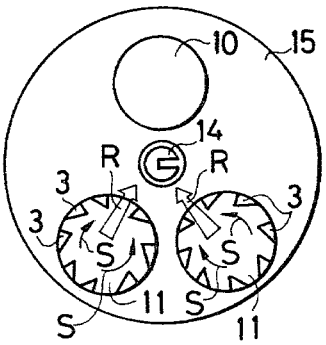
FIG. 14 is a schematic view of an embodiment of the invention wherein a flow of gas is directed from valves toward a plug by two of the present swirl generating devices.
Figure 15:
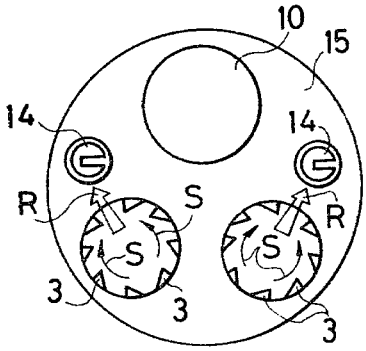
FIG. 15 is a schematic view of still another embodiment of the present invention wherein two of the present swirl generating devices are disposed within a cylinder head to cause the flow of gas to be directed towards two plugs.

FIGS. 14 and 15 are the cylinder heads of two embodiments of the present invention in which the flow of gas is also directed from the valves towards the plug or plugs by two double-swirl-generating devices.

What is claimed is:

1. In an internal combustion engine having an inlet manifold for directing a flow of air-fuel mixture in an axial direction in said manifold, a method for mixing the air-fuel mixture comprising the step of rotating the mixture partitively in different directions forming complex swirls, each swirl being rotated in an opposite direction with respect to its neighboring swirl, the swirls being located in planes substantially perpendicular to the direction of flow through said manifold.

2. A static mixer, comprising a cylindrical body member, a plurality of sets of wings, attached to the inner circumference of the cylindrical body of the mixer to change the flow directions of material passing through said member, the wings of each set facing in a different angular direction with respect to a tangent of the cylindrical body member where the wing is attached from its neighboring set such that said flow passing through said mixer is rotated partitively in different directions forming complex swirls, each swirl being rotated in an opposite direction from its neighboring swirl.

3. A static mixer, comprising a circular body member, a plurality of wings attached to the inner circumference of said circular body member to change the flow direction of material passing axially therethrough, said mixer further including at least a pair of separating wings, said separating wings facing each other to separate the flow in different directions in a plane normal to the flow direction through said mixer, said mixer further including at least a centering wing to direct the flow towards the center of said mixer, such that flow passing through said mixer is rotated partitively in different directions to form complex swirls in planes normal to the flow direction through said mixer, each swirl being rotated in an opposite direction from its neighboring swirl.

4. A static mixer as recited in claim 3 wherein said wings are formed by cutting and bending inwardly several portions of the circumference of the circular body of the mixer.

5. A static mixer as claimed in claim 3 wherein the mixer is fixedly positioned in the inlet manifold of an internal combustion engine having a carburetor with a slotter valve, the mixer having a pair of separating wings and a centering wing located on a line which is perpendicular to the axis of said slotter valve.

6. A static mixer as recited in claim 3 wherein the mixer is fixed in an inlet manifold of an internal combustion engine and wherein the total projecting area of said wings on the perpendicular plane of the flow direction of said mixture is between five and fifty percent of the total cross section area of said manifold.

7. In an internal combustion engine having a carburetor for forming an air-fuel mixture, an inlet manifold for directing said air-fuel mixture along a predetermined path, at least one combustion chamber for producing internal combustion of said air-fuel mixture, an ignition system for igniting said air-fuel mixture, an exhaust path for exhausting the burned gas of said air-fuel mixture from said combustion chamber, the improvement comprising a static mixer for forming complex swirls in a plane perpendicular to said predetermined path, said static mixer being located in said inlet manifold.

8. A static mixer fixed in the inlet manifold of an internal combustion engine as claimed in claim 7, wherein the mixer comprises a circular body member having a plurality of symmetric sets of wings, each set of wings generating a swirl which rotates in an opposite direction from its neighboring swirl when said mixture passes through the body member.

9. In an internal combustion engine having a manifold and an inlet port, a static mixer disposed in said manifold at a position near the inlet port, said mixer being comprised of a circular body member, a plurality of wings formed on the inner surface of the member, the mixer forming complex swirls when a mixture of gas and air passes through the mixer, each swirl being rotated in an opposite direction from its neighboring swirl said direction being in a plane transverse to said passing mixture direction.

10. The apparatus according to claim 9, wherein said mixer comprises two sets of wings arranged such that a line separating said two sets of wings intersects a plug of the engine.

11. The apparatus according to claim 9 wherein two static mixers are fixed in the manifold at a position near the inlet valves, each of said mixers comprising wings which direct the flow of the mixture to form a swirl which is rotated in an opposite direction from its neighboring swirl.

12. A combustion engine as recited in claim 9 wherein two static mixers are fixed in the manifold at respective positions near at least two inlet valves, each of said mixers comprising a plurality of wings which rotate the mixtures to form turbulence.

13. An internal combustion engine as recited in claim 12 wherein the wings of said mixers are arranged in such position so that flow of the mixture is in the direction of each of said valves toward the plug.

14. An internal combustion engine as recited in claim 9 wherein the air to fuel mixture is more than fifteen to one at most of its working conditions, the mixer being attached in the inlet manifold connecting the carburator and combustion chamber for generating complex swirls in said mixture when said mixture passes through said mixer.

* * * * *